US009060559B2

(12) United States Patent
Rojas Mas

(10) Patent No.: US 9,060,559 B2
(45) Date of Patent: Jun. 23, 2015

(54) SPORTS GARMENT

(75) Inventor: Juan Rojas Mas, Igualada (Barcelona) (ES)

(73) Assignee: Original Buff, S.A., Igualada (Barcelona) (ES)

( * ) Notice: Subject to any disclaimer, the term of this patent is extended or adjusted under 35 U.S.C. 154(b) by 0 days.

(21) Appl. No.: 13/190,649

(22) Filed: Jul. 26, 2011

(65) Prior Publication Data

US 2012/0023639 A1 Feb. 2, 2012

(30) Foreign Application Priority Data

Jul. 28, 2010 (ES) ..... 201030805 U

(51) Int. Cl.
*A42B 1/04* (2006.01)
*A41D 23/00* (2006.01)

(52) U.S. Cl.
CPC ..... *A42B 1/048* (2013.01); *A41D 23/00* (2013.01); *A41D 2200/20* (2013.01)

(58) Field of Classification Search
CPC ... A41D 2200/20; A41D 23/00; A42B 1/046; A42B 1/048
USPC ..... 2/84, 171, 202–209
See application file for complete search history.

(56) References Cited

U.S. PATENT DOCUMENTS

| | | | | | |
|---|---|---|---|---|---|
| 5,115,517 | A * | 5/1992 | Ferguson et al. | ..... | 2/203 |
| 5,251,336 | A * | 10/1993 | Nevins | ..... | 2/202 |
| 5,765,230 | A * | 6/1998 | Sivret et al. | ..... | 2/202 |
| 5,822,800 | A * | 10/1998 | Anderson | ..... | 2/202 |
| 5,960,478 | A * | 10/1999 | Sivret et al. | ..... | 2/202 |
| 6,088,838 | A * | 7/2000 | Sontag | ..... | 2/202 |
| 6,442,763 | B1 * | 9/2002 | Larson et al. | ..... | 2/202 |
| 7,096,511 | B2 * | 8/2006 | Cohen | ..... | 2/206 |
| 7,302,710 | B2 * | 12/2007 | Thomas et al. | ..... | 2/84 |
| 7,467,422 | B2 * | 12/2008 | Bugarin | ..... | 2/202 |
| 2005/0028242 | A1 * | 2/2005 | Thomas et al. | ..... | 2/84 |
| 2006/0130213 | A1 * | 6/2006 | Mickle | ..... | 2/202 |
| 2006/0143796 | A1 * | 7/2006 | Bugarin | ..... | 2/202 |
| 2009/0031472 | A1 * | 2/2009 | Gandy | ..... | 2/84 |
| 2009/0235426 | A1 * | 9/2009 | Johnston et al. | ..... | 2/84 |

FOREIGN PATENT DOCUMENTS

| | | |
|---|---|---|
| FR | 2 784 552 | 4/2000 |

* cited by examiner

*Primary Examiner* — Shaun R Hurley
*Assistant Examiner* — Andrew W Sutton
(74) *Attorney, Agent, or Firm* — Wenderoth, Lind & Ponack, L.L.P.

(57) ABSTRACT

SPORTS GARMENT, being those with a hood for covering the head of a user and an outer enclosing body surrounding the entire neck all the way around, the hood and the enclosing body coming together in a confluence zone (8) in which both elements join, characterized in that it comprises an inner tubular piece (6) arranged on the inside of the enclosing body (3), said inner tubular piece (6) being joined by its upper perimeter edge hanging down.

4 Claims, 7 Drawing Sheets

SPORTS GARMENT

OBJECT OF THE INVENTION

The present invention, as expressed in the title of this specification, relates to a sports garment intended to cover the head and neck of a person, in such a way that the bottom of the garment that covers the neck acts in principle as a scarf, while the top of the garment that covers the head acts as a hood.

On this premise, the novelty of the invention focuses on the structure that has the bottom of the garment by including a distinctive element or inner part the function of which is to reinforce the wrapping up of the head or the wrapping up of the neck of the user.

BACKGROUND OF THE INVENTION

At present, various garments are known, among which are noteworthy those that cover the head and neck, such as for example Utility Model No. U-200500259 referred to a head-dress cap for motorcycle driver, which basically comprises a top that covers the head, being free a frontal zone of the face, and a bottom that covers the neck and adjacent areas of the user.

Document U.S. Pat. No. 6,088,838 A discloses an adjustable hood having a cord which is capable of providing engagement between a face opening and a user's face as well as providing a snug fit at the rear of the hood.

Other garments including a terminal hood attached to the garment itself by an intermediate section that covers the neck of the user are also known.

Other well-known garments are scarves and hoods or hats.

Nevertheless, no evidence about garments wherein an inner tubular piece is independent and placed coinciding with an outer covering piece while it is not being used, forming a concentrically placed double parallel wall according to the present invention has been found.

DESCRIPTION OF THE INVENTION

The sports garment that is the object of the invention comprises, in principle, an upper part materialized by a hood and a bottom with a tubular structure materialized by an outer enclosing body that loosely covers the neck of the user and the contour of such neck, just as it happens with the hood that loosely covers the head of the user, although said hood has a cords device for adjusting the hood to the contour of the head.

The hood and the enclosing body converging in a confluence zone in which both elements are attached, wherein such sports garment comprises an inner tubular piece arranged on the inside of the enclosing body, said inner tubular piece being attached by its upper perimeter edge hanging down.

It is characterized in that the inner hanging tubular piece is attached at the confluence zone of the hood and the outer enclosing body, so that the inner tubular piece can be used at a first option as a reinforcement to cover the neck of the user together with the outer enclosing body when it is in rest position. Furthermore, the junction of the inner tubular piece at the confluence zone of the hood and the outer enclosing body is made by an annular seam. In this first option, the inner tubular piece can cover the lower part of the neck and/or also the upper part of the neck which is not covered with the hood (open) or the outer enclosing body.

In a second option, the inner tubular piece will be arranged as an additional hood elevating it upwards to cover part of the head of the user or part of it, being adjusted to said head. In this second option, the inner tubular piece covers part of the head at half of the cranium, covering also the ears of the user.

In a third option, the inner tubular piece covers, in a different amplitude, the face of the user: the chin, the mouth or the face up to the level below the eyes. The ears of the user can be covered in all the possibilities mentioned.

In a fourth option, the independent inner tubular piece is disposed within said hood, covering portions of the head of the user including the chin, up to a level immediately below the mouth and ears of the user.

The characteristic inner tubular piece made of breathable fabric, serves to further protect from inclement weather, reinforcing the coverage of the area wherein the user feels colder which can be the neck, the area of the face to below the eyes and also the ears.

Next, in order to facilitate a better understanding of this specification and forming an integral part of it some figures are attached in which by way of illustration and not limitation the object of the invention has been represented.

DESCRIPTION OF THE PREFERRED EMBODIMENT

Figure 1:
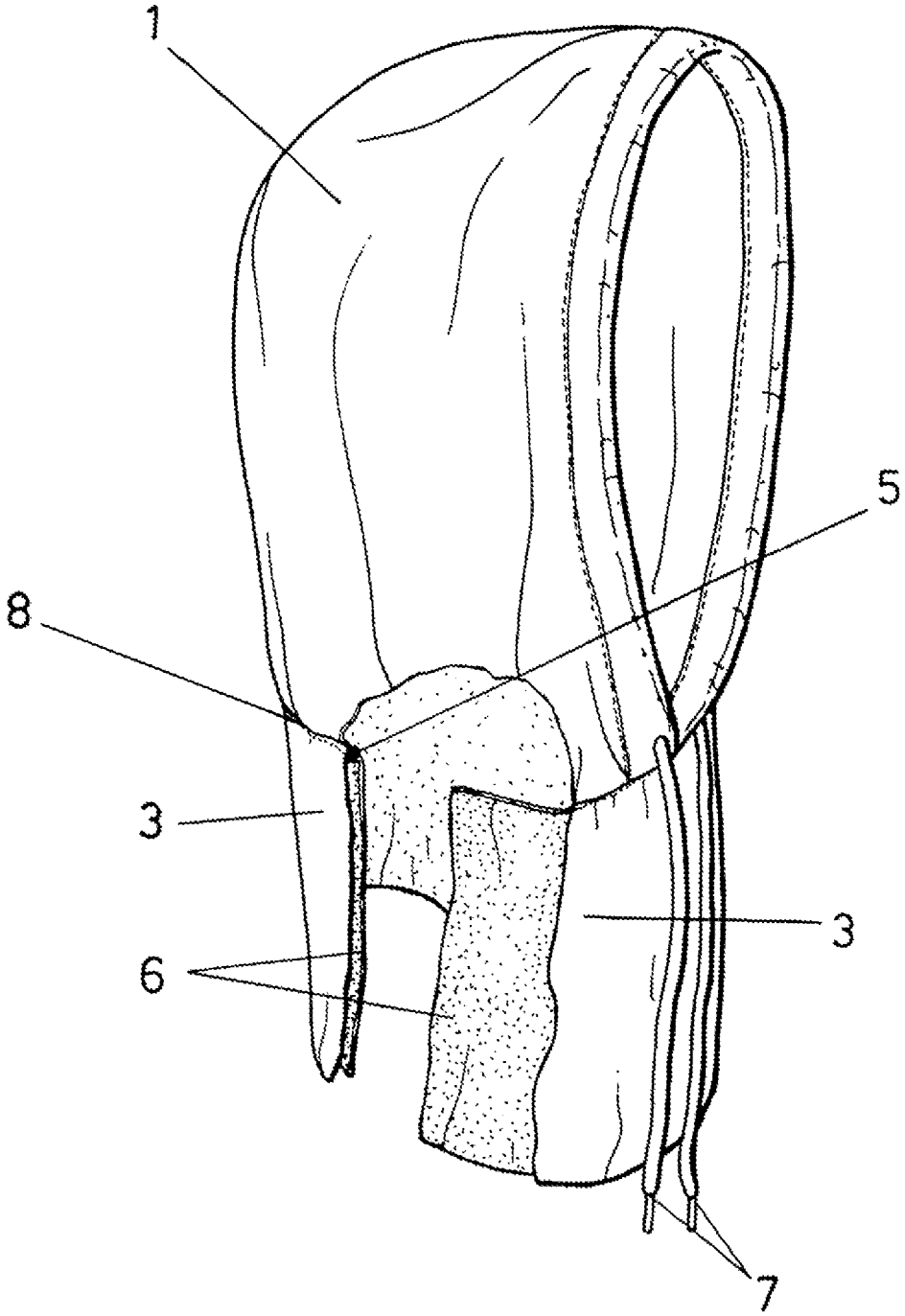
FIG. 1—Shows a perspective view of the sports garment of the invention. It includes a distinctive inner tubular piece as a reinforcing element in the wrapping up of the head or neck. In this FIG. 1 the inner tubular piece is arranged in correspondence with the neck along with an outer enclosing body.
Figure 2:
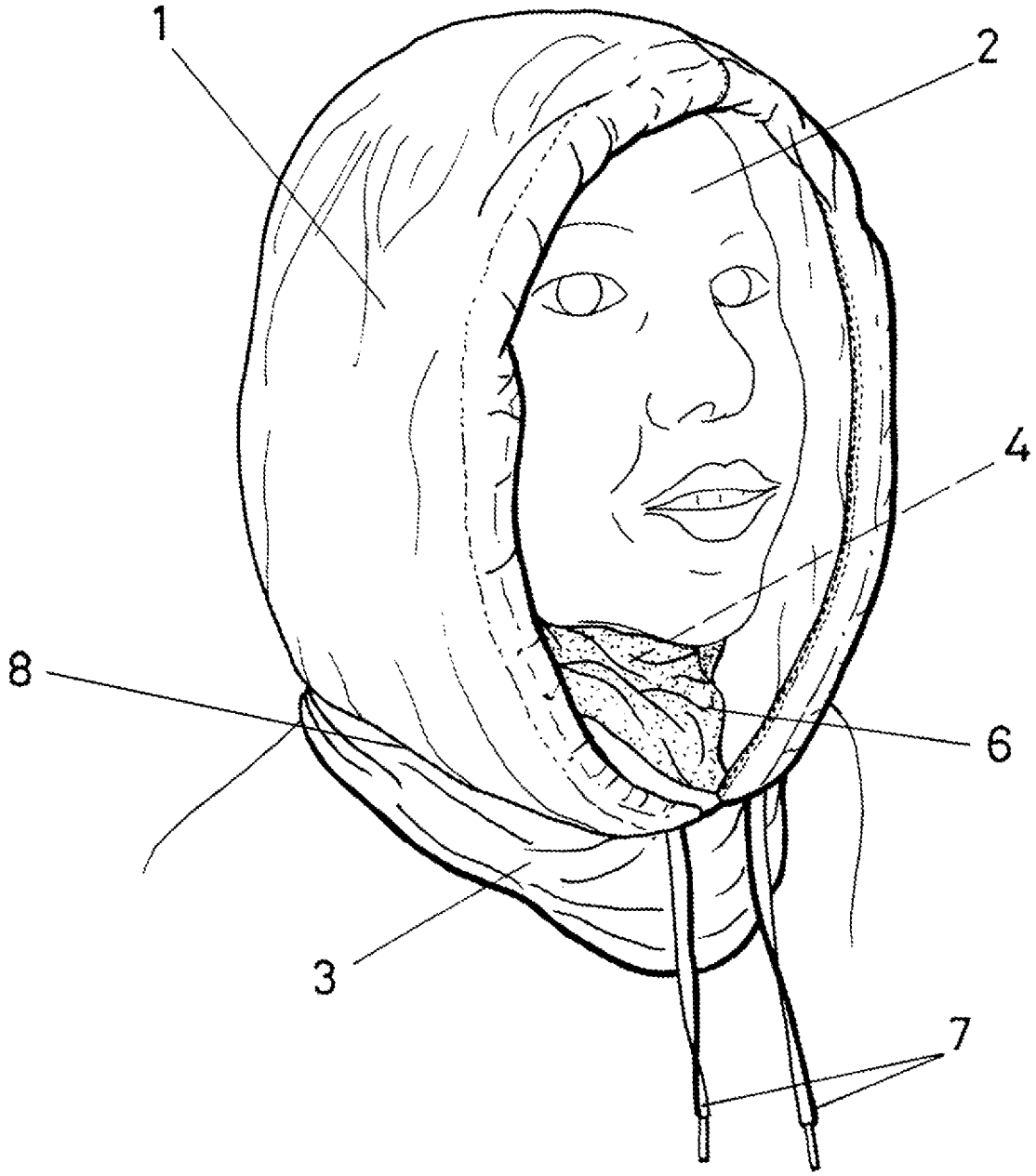
FIG. 2—Shows a perspective view similar to the previous one, where the sports garment is worn by a user so that the inner tubular piece is covering the neck together with the outer enclosing body.
Figure 3:
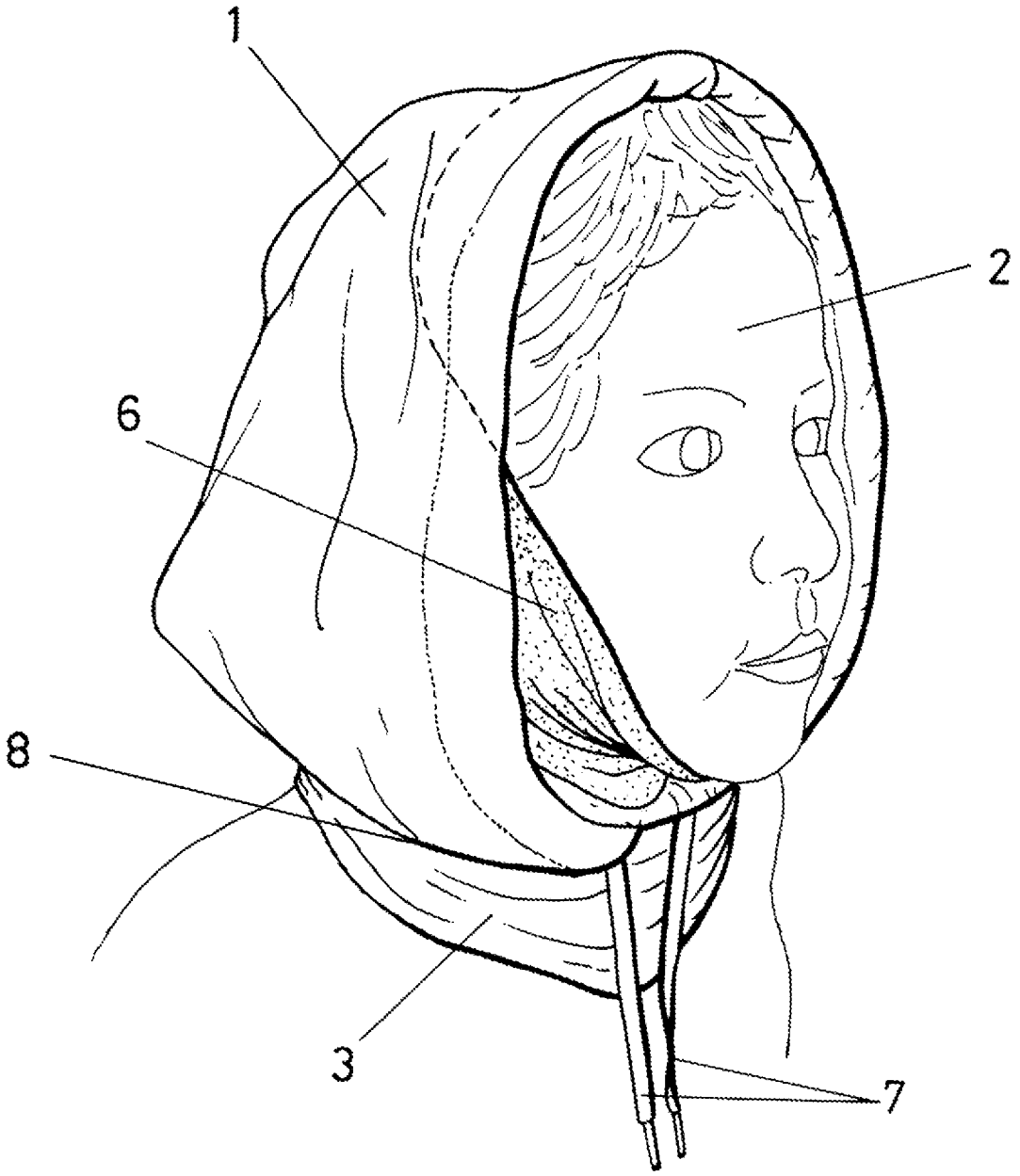
FIG. 3—Shows a view similar to the previous one, in which the inner tubular piece covers part of the head of the user together with the hood.
Figure 4:
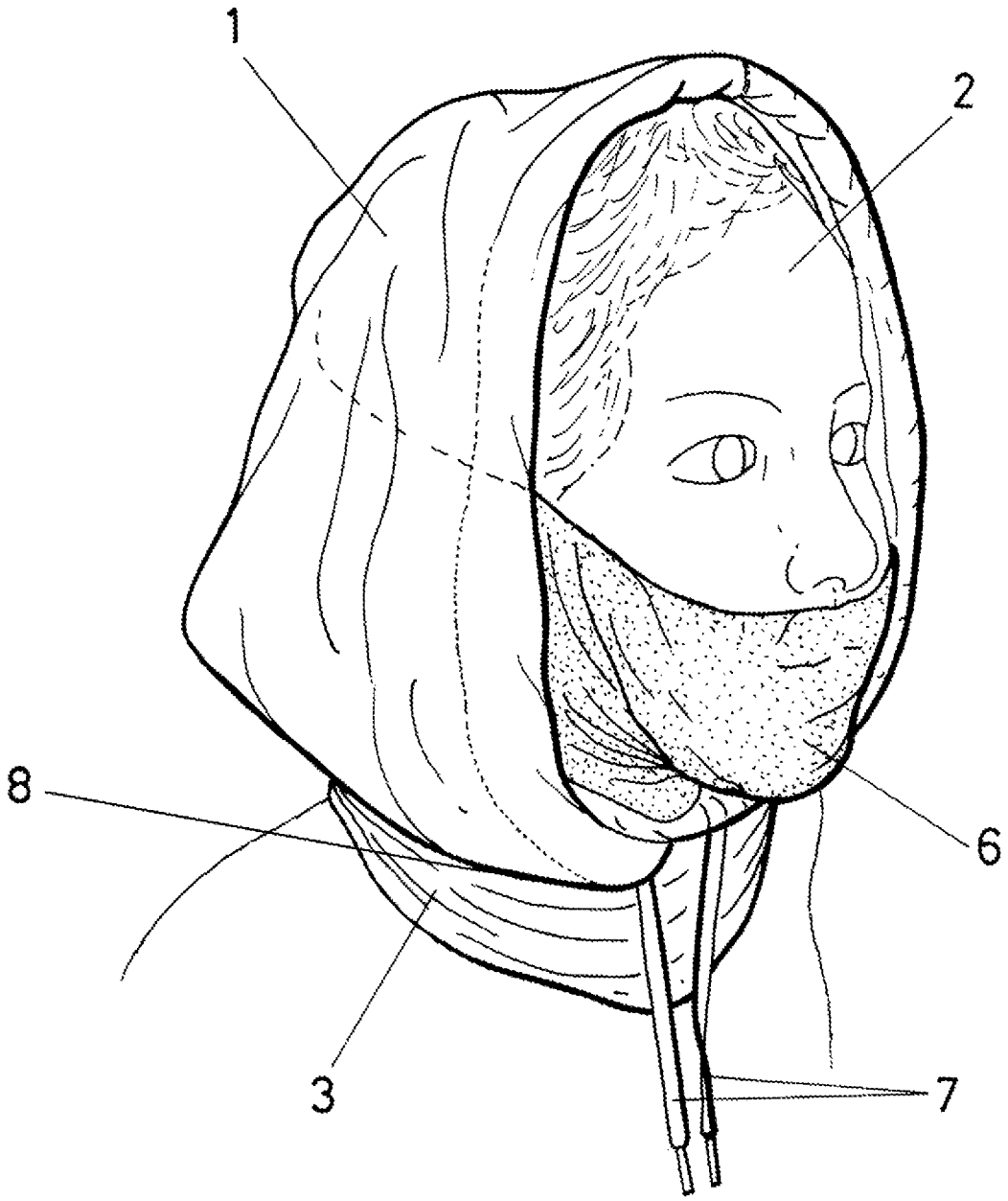
FIG. 4—Shows a view similar to the previous two in which the inner tubular piece covers part of the face of the user, covering the mouth to below the nose.
Figure 5:
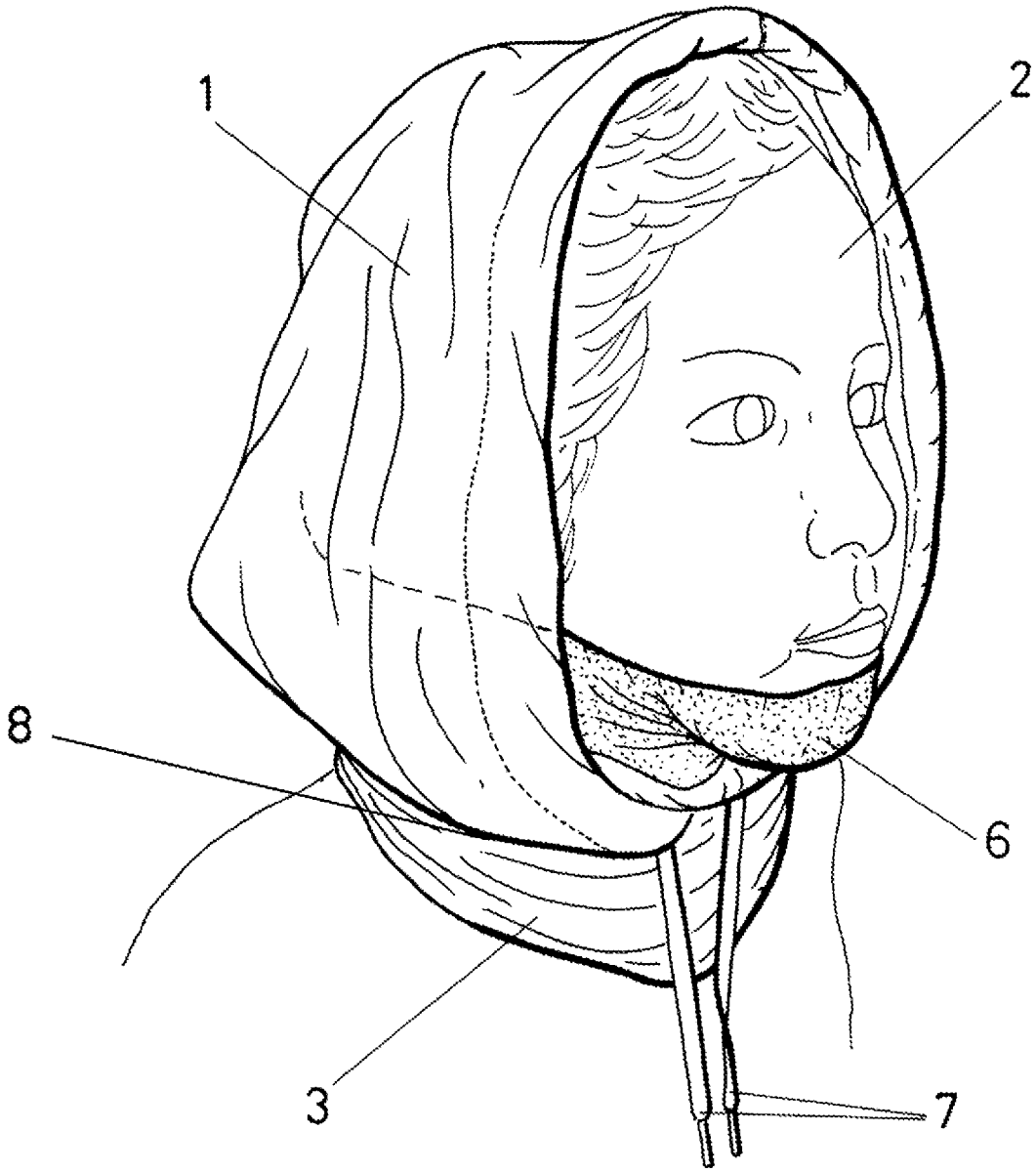
FIG. 5—Shows a view in which the inner tubular piece frontally covers only the chin of the user to below his mouth.
Figure 6:
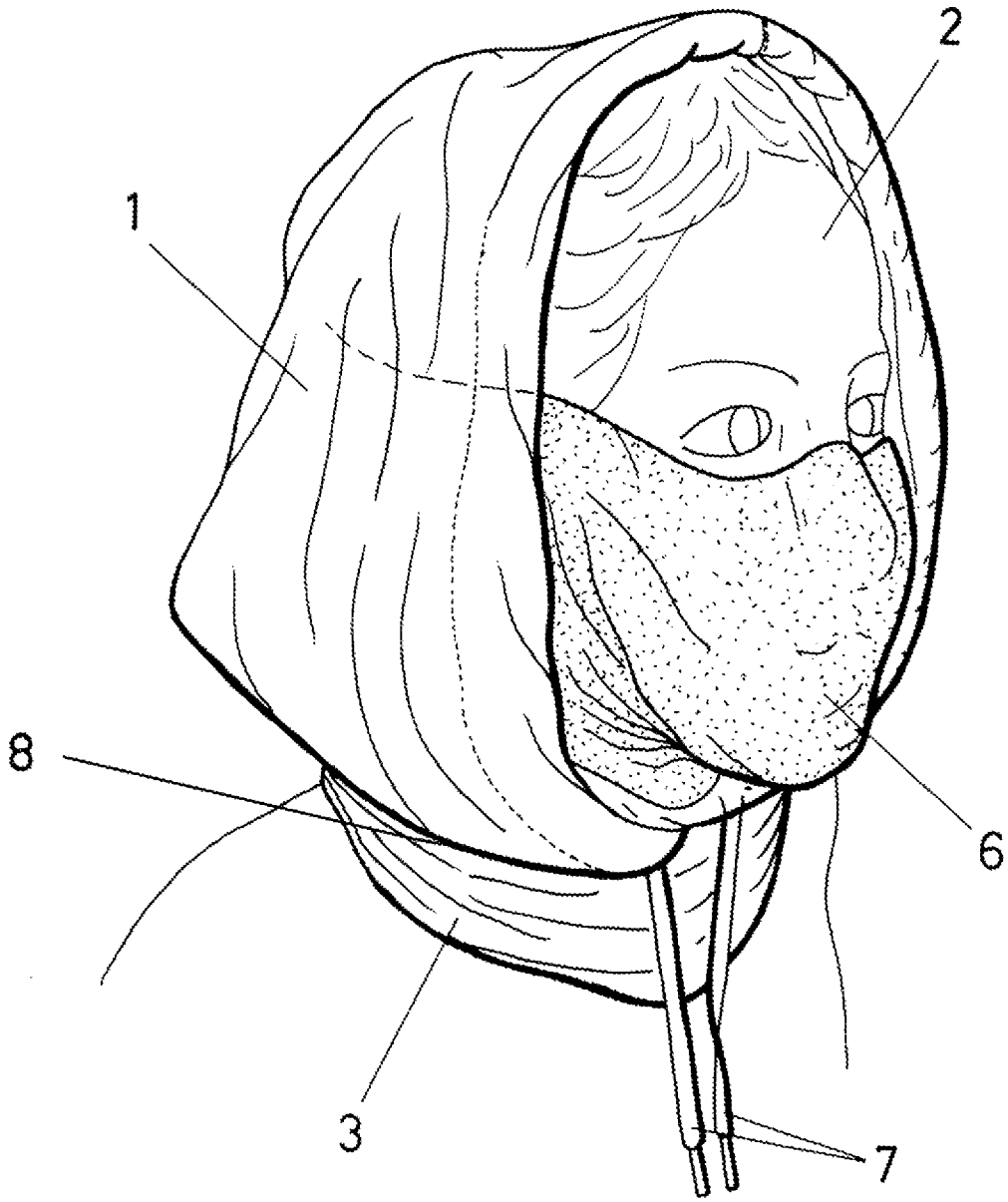
FIG. 6—Shows a view in which the inner tubular piece frontally covers much of the face of the user reaching the nose below the eyes.
Figure 7:
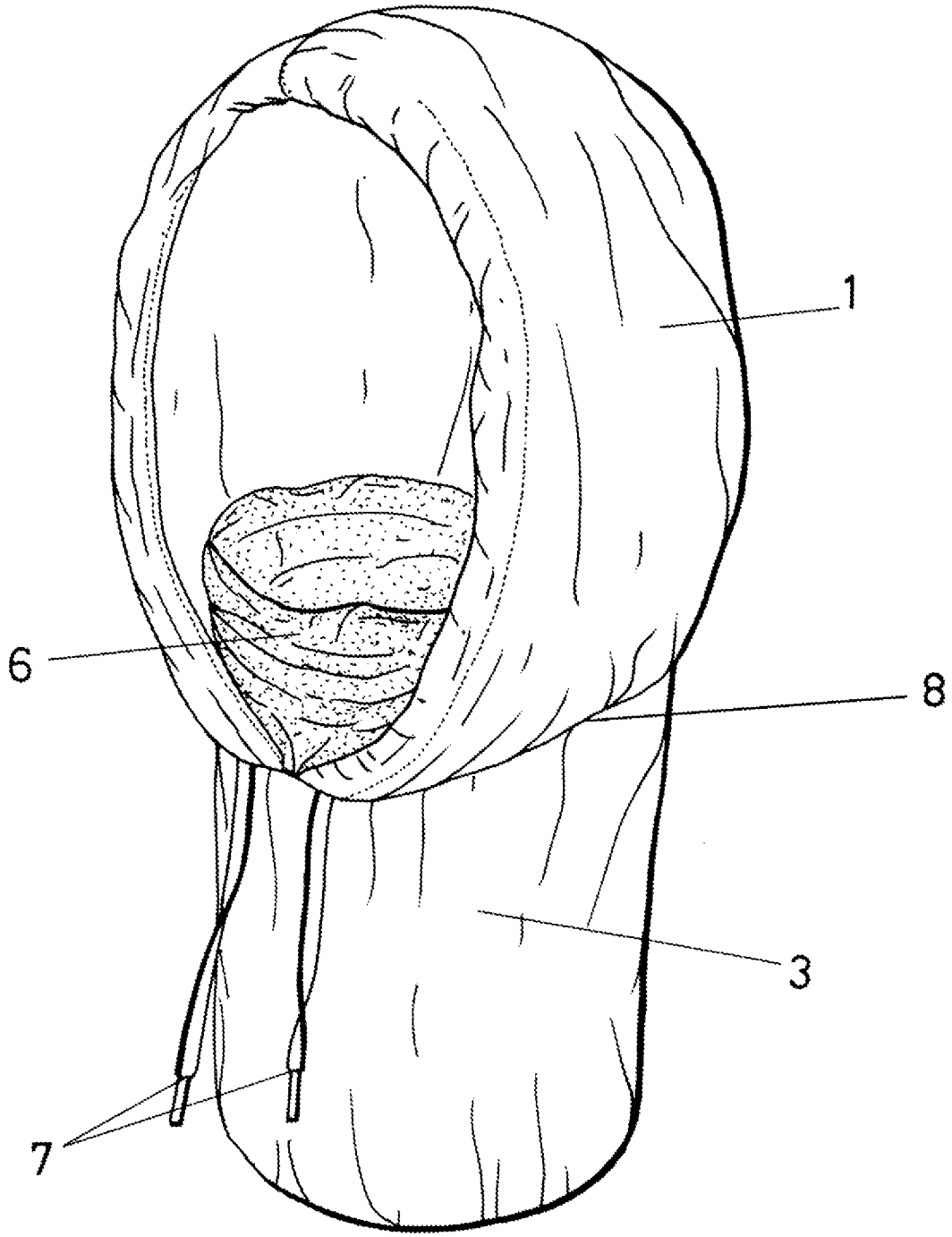
FIG. 7—Shows a view similar to FIG. 1 wherein the inner tubular piece is in a position in which it covers the upper neck, which is one of the characteristic functions of the inner tubular piece.

Considering the numbering adopted in the figures, the sports garment is determined by a hood 1 which covers the head 2 of the user and an outer enclosing body 3 which, in principle, covers the neck 4 of the same user, this coverage being loose-fitting in both cases. The hood 1 and the outer enclosing body 3 are joined together by an intermediate confluence zone (8) through an annular seam 5.

The garment includes a characteristic inner tubular piece 6 arranged inside the outer enclosing body 3, while it is attached to the garment assembly by means of the same annular seam 5 referred to above, so that such inner tubular piece 6 at normal state will reinforce the coverage and protection of the neck 4 of the user along with the outer enclosing body 3.

The inner tubular piece 6 is joined by the annular seam 5 by its upper perimeter edge.

In contrast, a second possibility is that the inner tubular piece 6 is used to partially and adjustably cover the head 2 of the user as a reinforcement element together with the hood 1. Thus, the inner tubular piece 6 covers the head of the user in part, up to about half of the cranium.

To place the inner tubular piece 6 in this position, the user will just have to pull his hands elevating upwards such inner tubular piece 6 to suit it to his head 2.

Within this second possibility, the inner tubular piece 6 can be placed in correspondence with the face of the user covering part of it, at least from the chin to the nose.

To place again the inner tubular piece 6 in the initial resting position in correspondence with the outer enclosing body 3, such inner tubular piece 6 will just be pulled downwards with the hands also until it is placed at the height of the upper neck.

The hood 1 has a cords device 7 to adjust said hood 1 to the contour of the head.

The invention claimed is:

1. A sports garment, having a hood (1) for covering the head of a user and an outer enclosing body (3) configured to surround a full contour of the entire neck of the user, the hood (1) and the outer enclosing body (3) converging in a confluence zone (8) in which the hood (1) and the outer enclosing body (3) are attached, wherein said sports garment comprises an independent inner tubular piece (6) which, in a normal state of the sports garment, is arranged on the inside of the outer enclosing body (3), and wherein the independent inner tubular piece (6), which is manufactured as a separate, distinct and independent piece of fabric with respect to both the outer enclosing body (3) and the hood (1), has a first perimeter edge attached by an annular seam at the confluence zone (8) of the hood (1) and the outer enclosing body (3), and a second, free perimeter edge, such that the independent inner tubular piece (6), in a normal state of the garment, hangs downwardly from said confluence zone (8) via said first perimeter edge;

said outer enclosing body (3), which is manufactured as a separate, distinct and independent piece of fabric with respect to both the independent inner tubular piece (6) and the hood (1), hangs downwardly from said confluence zone (8) to surround the neck of the user, and said independent inner tubular piece (6) is arranged such that, with the outer enclosing body (3) hanging downwardly from said confluence zone (8), the independent inner tubular piece (6) can be moved between:

a first position, corresponding to the normal state of the garment, hanging downwardly from said confluence zone (8) via said first perimeter edge such that said second, free perimeter edge is disposed below said confluence zone (8) and said independent inner tubular piece (6) is disposed inside said outer enclosing body (3);

a second position, in which the second, free perimeter edge is disposed above the confluence zone (8) and the independent inner tubular piece (6) is disposed within said hood (1), covering portions of the head of the user at half of the cranium, and covering the ears of the user; and a third position, in which the second, free perimeter edge is disposed above the confluence zone (8) and the independent inner tubular piece (6) is disposed within said hood (1), covering the face of the user, including the chin, and the nose up to a level immediately below the eyes, and covering the ears of the user;

a fourth position, in which the second, free perimeter edge is disposed above the confluence zone (8), and the independent inner tubular piece (6) is disposed within said hood (1), covering portions of the head of the user including the chin, up to a level immediately below the mouth and ears of the user;

wherein said independent inner tubular piece (6) and said outer enclosing body (3) are separate and distinct independent members, the fabric of the outer enclosing body (3) is different than the fabric of the independent inner tubular piece (6), and the outer enclosing body (3) and the independent inner tubular piece (6) are joined to one another and to said hood (1) via said annular seam at said confluence zone (8).

2. A sports garment, according to claim 1, wherein the independent inner tubular piece (6) is formed of a breathable fabric.

3. A sports garment, according to claim 1, wherein the hood (1), the outer enclosing body (3), and the independent inner tubular piece (6) are all mutually distinct independent pieces;

the hood (1) and the outer enclosing body (3) are attached together by the annular seam (5); and the independent inner tubular piece (6) is attached together with the hood (3) and the outer enclosing body (3) by said annular seam (5).

4. A sports garment, according to claim 1, wherein the hood (1), the outer enclosing body (3), and the independent inner tubular piece (6) are attached together by the annular seam (5) in such a manner that, with the hood (1) positioned above the outer enclosing body (3), the independent inner tubular piece (6), in its normal state, hangs downwardly in said first position to reinforce coverage and protection of the neck of the user along with the outer enclosing body (3).

* * * * *